US008694066B2

(12) United States Patent
Wang et al.

(10) Patent No.: US 8,694,066 B2
(45) Date of Patent: Apr. 8, 2014

(54) SUPERCONDUCTING MAGNET SYSTEM FOR HIGH POWER MICROWAVE SOURCE FOCUSING AND CYCLOTRON ELECTRONIC APPARATUS

(75) Inventors: Qiuliang Wang, Beijing (CN); Xinning Hu, Beijing (CN); Luguang Yan, Beijing (CN); Yinming Dai, Beijing (CN); Hui Wang, Beijing (CN)

(73) Assignee: Institute of Electrical Engineering, Chinese Academy of Sciences, Beijing (CN)

( * ) Notice: Subject to any disclaimer, the term of this patent is extended or adjusted under 35 U.S.C. 154(b) by 108 days.

(21) Appl. No.: 13/515,220

(22) PCT Filed: Jul. 14, 2010

(86) PCT No.: PCT/CN2010/001063

§ 371 (c)(1), (2), (4) Date: Jun. 11, 2012

(87) PCT Pub. No.: WO2011/127632

PCT Pub. Date: Oct. 20, 2011

(65) Prior Publication Data

US 2012/0289406 A1 Nov. 15, 2012

(30) Foreign Application Priority Data

Apr. 16, 2010 (CN) ..... 2010 1 052524

(51) Int. Cl.
*H01F 6/06* (2006.01)

(52) U.S. Cl.
USPC ..... 505/163

(58) Field of Classification Search
USPC ..... 505/163; 335/216
See application file for complete search history.

(56) References Cited

U.S. PATENT DOCUMENTS

| | | | | | |
|---|---|---|---|---|---|
| 4,590,428 | A * | 5/1986 | Muller et al. | ..... | 324/320 |
| 4,868,707 | A * | 9/1989 | Takechi | ..... | 361/141 |
| 5,136,273 | A * | 8/1992 | Ohta | ..... | 335/301 |
| 5,448,214 | A * | 9/1995 | Laskaris | ..... | 335/301 |
| 6,060,971 | A | 5/2000 | Sasaki et al. | | |
| 8,338,979 | B2 * | 12/2012 | Bray | ..... | 290/44 |
| 8,482,369 | B2 * | 7/2013 | Wang et al. | ..... | 335/216 |
| 2011/0082043 | A1 | 4/2011 | Wang et al. | | |

FOREIGN PATENT DOCUMENTS

| | | | |
|---|---|---|---|
| CN | 1508298 | A | 6/2004 |
| CN | 1745856 | A | 3/2006 |
| CN | 1959874 | A | 5/2007 |
| CN | 101499351 | A | 8/2009 |
| CN | 101552077 | A | 10/2009 |
| JP | 2008-140905 | A | 6/2008 |

OTHER PUBLICATIONS

International Search Report for International Application No. PCT/CN2010/001063, mailed Jan. 27, 2011.

* cited by examiner

*Primary Examiner* — Colleen Dunn

(57) ABSTRACT

A superconducting magnet system for high power microwave source focusing and cyclotron electronic apparatus is provided, wherein, the superconducting magnet comprises an inner superconducting main coil, an outer superconducting main coil, two end compensation coils, a regulating coil and a central regulating coil. These coils are formed by coiling $Nb_3Sn/Cu$ superconducting wire. The superconducting magnet can operate off-line through solid nitrogen formed by a cryocooler and high-pressure nitrogen. The superconducting magnet and the superconducting switch constitute a closed loop, thereby achieving magnetic field stability, without outside electromagnetic interference. The superconducting magnet system can provide a magnetic field having special spatial distribution and high stability.

6 Claims, 2 Drawing Sheets

SUPERCONDUCTING MAGNET SYSTEM FOR HIGH POWER MICROWAVE SOURCE FOCUSING AND CYCLOTRON ELECTRONIC APPARATUS

CROSS-REFERENCE TO RELATED APPLICATIONS

This application claims priority under 35 U.S.C. §371 to, and is a U.S. national phase application of, International Application No. PCT/CN2010/00/001063, filed Jul. 14, 2010, entitled "SUPERCONDUCTING MAGNET SYSTEM FOR HIGH-POWER MICROWAVE SOURCE FOCUS AND ELECTRON CYCLOTRON DEVICE," which claims priority to Chinese Application No. 201010152524.4, filed Apr. 16, 2010, the disclosures of each are incorporated herein by reference in their entirety.

TECHNICAL FIELD

The present invention relates to a superconducting magnet system, and more particularly, relates to a superconducting magnet system for high power microwave source focusing and cyclotron electronic apparatus.

BACKGROUND ART

A high power gyrotron device is capable of outputting a continuous wave energy of peak power on the order of megawatt and a frequency spectrum. In order to realize the functionality of a gyrotron device and to produce a strong focusing, a special superconducting magnet is needed to satisfy the magnetic field required by gyro-frequency. The magnet system has a particular magnetic field distribution and a high stable magnetic field. Since the magnet needs to operate in a special environment, the magnet system is required to have a small volume, a light weight and a good removability as well as be easy to operate and manipulate.

In order to develop an extremely high magnetic field to achieve a particular spatial distribution and temporal stability, a number of technical difficulties exist when using conventional technologies, because the magnet of an ordinary electromagnetic structure has the disadvantages of high loss, large volume or the like. Therefore, the conventional system cannot suit to the requirements of special equipment. Furthermore, the cooling of the conventional superconducting magnet is achieved by being immersed with low temperature liquid, which brings lots of inconveniences to the operation and movement of the superconducting magnet system. In addition, the use of the conventional superconducting magnet system in a motion system would cause much more difficulties for use and maintenance.

A superconducting magnet structure with a single coil has the advantages of being simple in structure, easy to be constructed, convenient for use or the like, but the magnetic field generated by such superconducting magnet cannot satisfy the magnetic field of a special and complex configuration required by system operation. For suiting the application needs of special electrician equipment, improving the functionality and usability of the equipment, and achieving the requirement that the operation parameter of the high power microwave source reaches the required output frequency spectrum and band width, an innovative superconducting magnet for electromagnetic focusing and electron cyclotron is needed, such that the magnetic field stability and the spatial distribution characters of the magnetic field of the gyrotron device can be achieved. The superconducting magnet system adopting a new electromagnetic structure and cooling manner can meet the actual requirements of the high power microwave source, thereby achieving the application demands of the microwave device in fields like microwave special equipment and microwave industry processing.

The superconducting magnet system for high power microwave source focusing and cyclotron electronic apparatus is suitable for super gravity, rapid movement and rotation special electron cyclotron and focusing apparatus, can operate in a field environment of extremely harsh temperature and humidity, and has the advantages of high magnetic field stability and anti-external electromagnetic interference.

SUMMARY OF THE INVENTION in order to overcome the defects in the prior art, the present invention provides a superconducting magnet system with a particular spatial magnetic field distribution. The present invention employs a liquid-helium-free superconducting magnet system which is cooled directly by a cryocooler, thereby no low temperature liquid is required, the weight and the volume of the magnet system is reduced, and use and operation of the magnet system is convenient and the magnet system has removability. The present invention can realize the magnetic field and operational modal required by the high power microwave source thereof.

The superconducting magnet of the present invention is formed by a plurality of superconducting coils in combination, it primarily includes two superconducting main coils and a plurality of small superconducting coils in different positions, and generates a certain magnetic field ratio of $B_r/B_z$ at a spatially special point so as to satisfy electron focusing and relatively high gyro-frequency, wherein, $B_r$ is magnetic field along the radial direction of the magnet and $B_z$ is magnetic field along the axial direction of the magnet.

The superconducting magnet system of the present invention is composed of six superconducting coils including an inner superconducting main coil, an outer superconducting main coil, two end compensating coils, an end regulating coil and a central regulating coil. The inner and outer superconducting main coils generate a central magnetic field of 4.5 T for providing background magnetic field, and the compensating coils are used for ensuring the magnetic field homogeneity of two homogeneous regions. The two regulating coils are used for compensating the axial magnetic field homogeneity of the main coils and regulating the ratio of the axial and the radial magnetic field intensities of the spatially special points A, B, C, D, E, and F, i.e. magnetic field compression ratio: $B_z/B_r$. The six superconducting coils are co-axial, wherein, the outer superconducting main coil is at the outside of the inner superconducting main coil, and, at the outside surface of the outer superconducting main coil, there are end compensating coils, the regulating coil and the central regulating coil in turn from the ends of the magnet.

The magnet and the cryogenic system of the present invention have a better low temperature thermal connection. The six superconducting coils of the superconducting magnet use a same former, on which a slit is cut for reducing eddy current. Around the former, the inner superconducting main coil is firstly wound, and then the outer superconducting main coil is wound. An epoxy fiberglass tape is wound around the surface of the outer superconducting main coil and then a low-temperature epoxy resin is added for curing. After the low-temperature epoxy resin has been cured, the surface is polished using a mechanical machining process. The smooth surface is then wound with the end compensating coil. The end compensating coil is composed of two compensating coils which are symmetrically distributed at the ends of the outer superconducting main coil. Then, between the two compensating coils of the end compensating coil, the regulating coil and the centre regulating coil are arranged from left to right.

The present invention employs a superconducting switch to connect all the superconducting coils, thereby forming a closed-loop steady current and thus generating a magnetic field having a relatively high stability. The superconducting coils are connected with the superconducting switch through a superconducting joint whose resistance is less than $10^{-12}\Omega$. The superconducting switch is characterized in that thermal connection with the magnet is realized by a flange that connects the magnet. A supporting rod is used for controlling the switch so as to prevent heat from flowing towards the magnet in condition of being opened and serving as a thermal bridge so as to restore the switch to superconducting state in condition of being closed. The switch-trigger heater and the superconducting switch wire are juxtaposed together and double wound around the copper former. The operation of the switch is controlled using an external power source, thereby achieving closed-loop operation of the magnet.

The superconducting coils of the present invention employ $Nb_3Sn$/Cu material having a higher critical property. Under the cooperation of the solid nitride with high heat capacity, the heat switch and the cryocooler, an off-line operation of the magnet can be achieved.

The present invention establishes a coordinate (z, r) of an axial and radial coordinate system by taking the geometric center of the superconducting magnet system, i.e. the magnetic field central point of the superconducting magnet, as the coordinate origin. In this space, the coordinates of the six special points are: A(−245 mm, 40 mm), B(−230 mm, 36 mm), C(−115 mm, 20 mm), D(115 mm, 20 mm), E(155 mm, 22 mm), F(180 mm, 23 mm). The magnetic field distribution requires that points C and D are on the same magnetic force line, meanwhile the magnetic force line that passes through these two points is not higher than the points A, B, E, and F. At the given magnetic field points, $B_r(D)/B_z(D)\leq 3\%$, $B_r(E)/B_z(E)\leq 7\%$, $B_r(F)/B_z(F)\leq 11\%$ are satisfied, and the axial distance Z between point C and point D is less than 180 mm, the magnetic field compression ratio in the magnet axes is larger than 88%, that is, $B_z(180\text{ mm})4.5>88\%$. In the above expression, $B_r$ is the magnetic field along the radial direction of the magnet, and $B_z$ is the field intensity along the axial direction of the magnet.

From the area occupied by the superconducting coils, the bore range of the magnet, the length of the coils, the equivalent current is distributed over the surface of a cylinder having a mean radius $R_1$; the effective distribution magnetic field range for the coils is $L_1$; according to cyclotron focus magnetic field distribution, a linear equation AI=B is established for the magnetic field and the current, wherein, the matrix A is the magnetic field coefficient matrix and B is the axial magnetic field matrix; after a regularization processing method is introduced, the ill-conditioned equation AI=B is transformed to a general equation $(A^TA+\alpha L^TL)I=A+^TB$, wherein, L is a unit matrix and a is a regularization factor. Then, the general equation $(A^TA+\alpha L^TL)I=A^TB$ is solved to obtain the coil current I, thereby determining the spatial distribution of the coil current I.

The present invention employs a genetic simulated annealing hybrid algorithm to optimize the coil section: taking the obtained current position and amplitude as initial parameters, considering the minimization of a square function of the difference of weighted magnetic fields as optimization objective, and using the genetic simulated annealing hybrid algorithm to optimize the coil section.

In order to realize that the superconducting magnet can be cooled quickly and the system can operate off-line, the superconducting coils of the present invention use superconducting material having high critical property $Nb_3Sn$/Cu, wherein, $Nb_3Sn$ has a critical temperature of 18K. The superconducting magnet has a heat exchanger wound around its surface, and the heat exchanger is connected with a high-pressure nitrogen container; the cryocooler cools the superconducting magnet and the high-pressure nitrogen container; all of the superconducting coils are connected with the superconducting switch through superconducting joint, thus forming a closed-loop steady current. At the periphery of the superconducting coils, the heat exchanger is used, with cooled high heat capacity solid nitride being inside the high-pressure nitrogen container, which causes the temperature rebound speed of the superconducting magnet to be extremely slow after the magnet being charged and the cryocoolers being stopped. The system overall operating temperature can be within a range from 4.2K to 12K with normal operation.

The superconducting magnet system of the present invention can provide strong magnetic focusing and cyclotron system requirement, which is suitable for operation under field special conditions, significantly reduces system operation cost and is more convenient and reliable for use.

DETAILED DESCRIPTION OF THE PREFERRED EMBODIMENTS

The present invention will be further described below in conjunction with the attached drawings and the embodiments.

Figure 1:
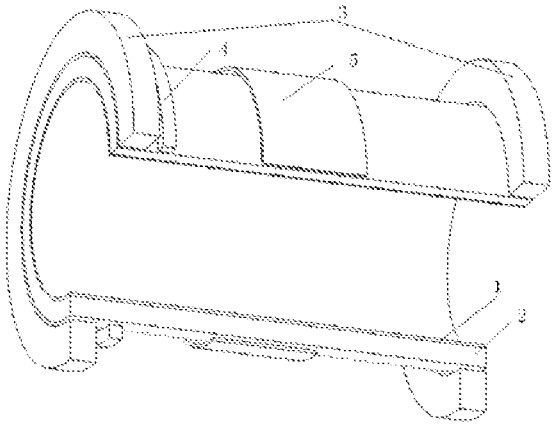
FIG. 1 is a diagram showing a combination manner of superconducting coils of the present invention, in which, 1 denotes inner superconducting main coil, 2 denotes outer superconducting main coil, 3 denotes end compensating coil, 4 denotes regulating coil, 5 denotes central regulating coil.

FIG. 1 shows superconducting coils used in the magnet system of the present invention. An inner superconducting main coil 1 is placed in a higher magnetic field region and operates in a low current density state. An outer superconducting main coil 2 is located outside the inner superconducting main coil 1 and operates in a high current density. The inner superconducting main coil 1 and the outer superconducting main coil 2 work together to generate a main magnetic field of the magnet system. The outer superconducting main coil 2 is co-axial with the inner superconducting main coil 1 and directly coiled around the outside surface of the inner superconducting main coil 1, and has a length same as that of the inner superconducting main coil 1. The end compensating coil 3 compensates the homogeneity distribution character of the magnetic field and is composed of two compensating coils which are symmetrically distributed at the ends of the outer superconducting main coil 2. Then, between the two compensating coils of the end compensation coil 3, there provides a regulating coil 4 and a central regulating coil 5 from left to right. The regulating coil 4 and the central regulating coil 5 are used for regulating the magnetic field distribution of the magnet at each spatial point. The magnetic field of the superconducting magnet realizes: $B_r(D)/B_z(D) \leq 3\%$, $B_r(E)/B_z(E) \leq 7\%$, $B_r(F)/B_z(F) \leq 11\%$; within a range where $Z<180$ mm, the magnetic field compression ratio in the magnet axes Bz/Br is larger than 88%, that is, $B_z(180\text{ mm})/4.5>88\%$.

Figure 2:
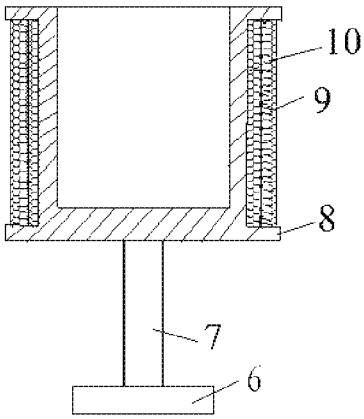
FIG. 2 is a structure of a superconducting switch of the present invention, in which, 6 denotes flange, 7 denotes switch supporting rod, 8 denotes switchformer, 9 denotes switch trigger heater, 10 denotes superconducting switch coil.

FIG. 2 shows a structure of a superconducting switch of the present invention. A superconducting switch 18 for realizing a closed-loop operation of magnet current includes a flange 6 that connects to the magnet, a supporting rod 7, a switch triggered heater 9 and a superconducting switch coil 10. The superconducting switch 18 realizes the thermal connection between the superconducting switch 18 and the superconducting magnet through the flange 6 that connects to the magnet. The supporting rod 7 controls the superconducting switch 18 to prevent thermal flow from flowing towards the magnet when it is on and serves as a heat bridge to restore the superconducting switch to a superconducting state when it is off The switch triggered heater 9 and the superconducting switch coil 10 are coiled around the switch former 8. The operation of the superconducting switch 18 is controlled using an external power source, thereby achieving a closed-loop operation of the superconducting magnet.

Figure 3:
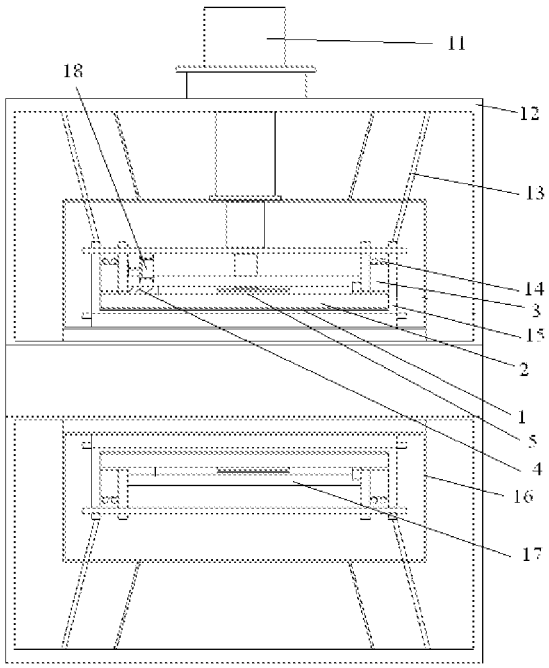
FIG. 3 is a cryogenic system of a superconducting magnet of the present invention, in which, 11 denotes cryocooler, 12 denotes vacuum vessel, 13 denotes support rod, 14 denotes heat exchanger, 15 denotes superconducting magnet, 16 denotes thermalshield, 17 denotes high-pressure nitrogen container, and 18 denotes superconducting switch.

FIG. 3 shows a low temperature system for ensuring that the superconducting magnet operates normally. As shown in FIG. 3, a cryocooler 11 provides a low-temperature cold energy, and the degree of vacuum within a vacuum vessel 12 is less than $10^{-5}$Pa. The superconducting magnet 15 is supported within the vacuum vessel 12 by a supporting rod 13. The cryocoolers 11 cools the superconducting magnet 15 by a heat exchanger 14. The cold conduction structure at the two ends of the superconducting magnet 15 is connected to a secondary cold head of the cryocoolers 11. The superconducting magnet 15 has the heat exchanger 14 wounded around its surface. The heat exchanger 14 is connected to a high-pressure nitrogen pressure container 17 which is wrapped outside the superconducting magnet 15 such that there has an extremely high thermal conductivity between the high-pressure nitrogen pressure container 17 and the superconducting magnet 15. The cryocooler 11 cools the high-pressure nitrogen pressure container 17. A thermal radiation shield 16 is connected to a primary cold head of the cryocooler 11 to be ensured to have a temperature of 40 k so as to prevent the thermal radiation of 300 k external temperature. All the superconducting coils of the superconducting magnet 15 are connected together and then form a closed current loop with the superconducting switch 18, thereby guaranteeing the stability of the magnetic field.

The invention claimed is:

1. A superconducting magnet system for high power microwave source focusing and cyclotron electronic apparatus, comprising:

a cryocooler, a vacuum vessel, a supporting rod, a thermal radiation shield, and a low temperature system and superconducting magnet, characterized in that: in said superconducting magnet system, the superconducting magnet includes an inner superconducting main coil, an outer superconducting main coil, an end compensating coil, a regulating coil and a central regulating coil;

said inner superconducting main coil, said outer superconducting main coil, said end compensating coil, said regulating coil and said central regulating coil are coaxially arranged;

said inner superconducting main coil operates in a low current density state;

said outer superconducting main coil is located outside said inner superconducting main coil and operates in a high current density state;

said inner superconducting main coil and said outer superconducting main coil work together to generate a main magnetic field of the magnet system;

said outer superconducting main coil is coiled around the outside surface of the inner superconducting main coil and has a length same as that of the inner superconducting main coil;

on the outside surface of said outer superconducting main coil, the end compensating coil, the regulating coil and the central regulating coil are arranged in turn from the ends of the magnet;

the superconducting magnet has a heat exchanger wounded around its surface;

the heat exchanger is connected to a high-pressure nitrogen container;

said cryocoolers cools the superconducting magnet and the high-pressure nitrogen container;

all the superconducting coils are connected to a superconducting switch through superconducting joint, forming a closed-loop steady current.

2. The superconducting magnet system for high power microwave source focusing and cyclotron electronic apparatus according to claim 1, characterized in that, said end compensating coil is composed of two compensating coils which are symmetrically distributed at the ends of the outer superconducting main coil, and between the two compensating coils, the regulating coil and the central regulating coil are arranged from left to right.

3. The superconducting magnet system for high power microwave source focusing and cyclotron electronic apparatus according to claim 1, characterized in that, said superconducting switch realizes the thermal connection between the superconducting switch and the superconducting magnet by a flange that connects to the superconducting magnet; a switch supporting rod controls the superconducting switch to prevent thermal flow from flowing towards the superconducting magnet when it is on and serves as a heat bridge to restore the superconducting switch to a superconducting state when it is off; the switch triggered heater and the superconducting switch wire are juxtaposed and double wound around a former of the superconducting switch.

4. The superconducting magnet system for high power microwave source focusing and cyclotron electronic apparatus according to claim 1, characterized in that, a coordinate (z, r) of an axial and radial coordinate system is established by taking a magnetic field central point of the superconducting magnet as an origin of the coordinate; six special points are established in this space, wherein the coordinates for the six special points are: A(−245 mm, 40 mm), B(−230 mm, 36 mm), C(−115 mm, 20 mm), D(−155 mm, 20 mm), E(−155 mm, 22 mm), F(−180 mm, 23 mm); points C and D are on the same magnetic force line and the magnetic force line passing through points C and D is not higher than the points A, B, E, and F; when the given magnetic field points satisfy: $Br(D)/Bz(D) \leq 3\%$, $Br(E)/Bz(E) \leq 7\%$, $Br(F)/Bz(F) \leq 11\%$, and an axial distance Z between point C and point D is less than 180 mm, a magnetic field compression ratio in the magnet axes is larger than 88%, that is, $Bz(180\text{ mm})/4.5>88\%$; in the above expression, Br denotes the magnetic field along the radial direction of the magnet and Bz denotes the magnetic field along the axial direction of the magnet.

5. The superconducting magnet system for high power microwave source focusing and cyclotron electronic apparatus according to claim 1, characterized in that, all coils of the superconducting magnet use Nb3Sn/Cu superconducting wire having high critical property for coiling.

6. The superconducting magnet system for high power microwave source focusing and cyclotron electronic apparatus according to claim 1, characterized in that, said inner superconducting main coil, said outer superconducting main coil, said end compensating coil, said regulating coil and said central regulating coil of the superconducting magnet use one and the same former, on which there provides a slit; around the former, the inner superconducting main coil is firstly wound, and then the outer superconducting main coil is wound; an epoxy glass tape is used to wind the surface of the outer superconducting main coil and then a low-temperature epoxy resin is added for curing; after the low-temperature epoxy resin has been cured, the surface is polished using a mechanical machining process; the smooth surface is then coiled with the end compensating coil, the regulating coil and the central regulating coil.

* * * * *